United States Patent [19]

Yang

[11] 4,047,389

[45] Sept. 13, 1977

[54] PRECAST CONCRETE PILE, AND COFFERDAMS

[75] Inventor: Yue-Chyou Yang, San Francisco, Calif.

[73] Assignee: T. Y. Lin International, San Francisco, Calif.

[21] Appl. No.: 669,341

[22] Filed: Mar. 22, 1976

[51] Int. Cl.[2] ..... E02D 5/10; E02D 5/30

[52] U.S. Cl. ..... 61/59; 61/39; 61/50; 61/56

[58] Field of Search ..... 61/49, 59, 56, 53, 53.5, 61/39; 52/169

[56] References Cited

U.S. PATENT DOCUMENTS

| | | | |
|---|---|---|---|
| 1,198,459 | 9/1916 | Langworthy | 61/59 |
| 1,393,545 | 10/1921 | Knuth | 61/59 |
| 1,529,113 | 3/1925 | Burns | 61/56 |
| 1,842,849 | 1/1932 | Turner | 61/59 |
| 2,099,543 | 4/1937 | Stevens | 61/59 |
| 2,192,508 | 3/1940 | Simpson | 61/59 |
| 3,522,707 | 8/1970 | Fuentes, Jr. | 61/59 |
| 3,651,653 | 3/1972 | Mouton, Jr. | 61/53 |

*Primary Examiner*—Paul R. Gilliam
*Assistant Examiner*—Alex Grosz
*Attorney, Agent, or Firm*—Owen, Wickersham & Erickson

[57] ABSTRACT

A precast concrete pile and cofferdams, etc., made therefrom, employing a new method. A rectangular main stem extends from the top to the bottom of the pile, a lower portion of the pile consisting exclusively of the main stem. An upper portion of the pile incorporates, integrally with the stem, a pair of generally rectangular flanges each extending out from one of two opposing faces along one edge of the stem and set back from the opposite edge. The piles may be driven next to each other, with the flanges of successive piles overlapping, to make a continuous cofferdam or retaining wall, especially well suited for bridge piers.

6 Claims, 20 Drawing Figures

FIG. 5
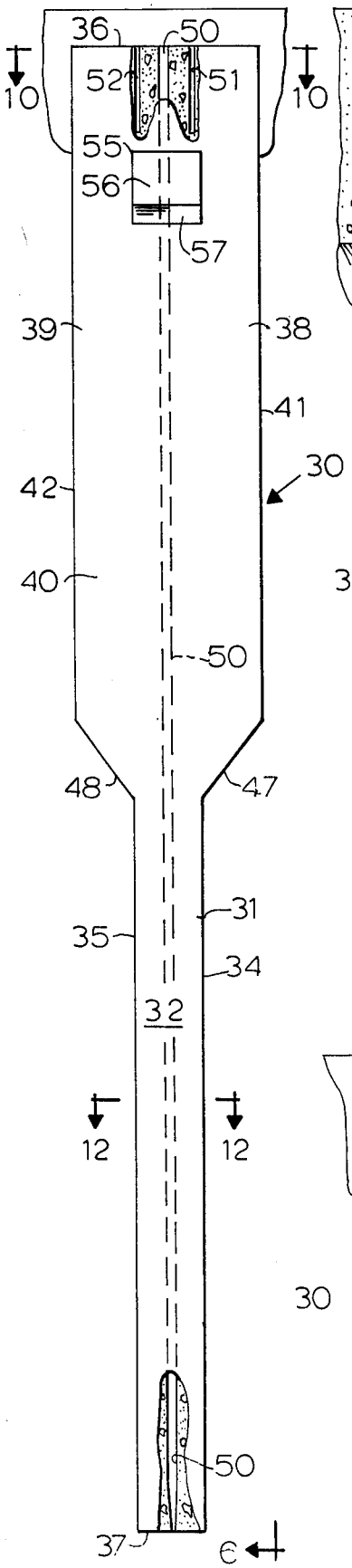
FIG. 6
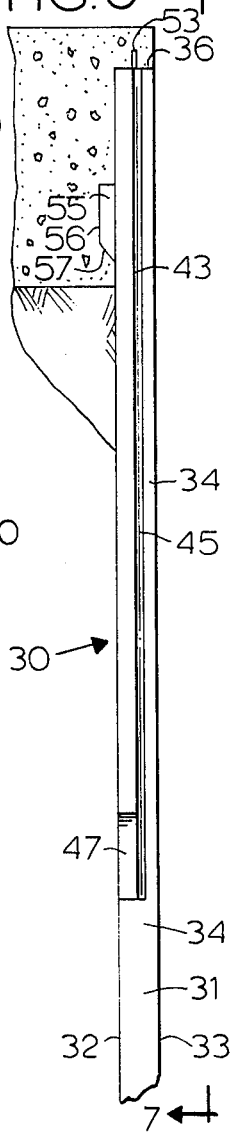
FIG. 8
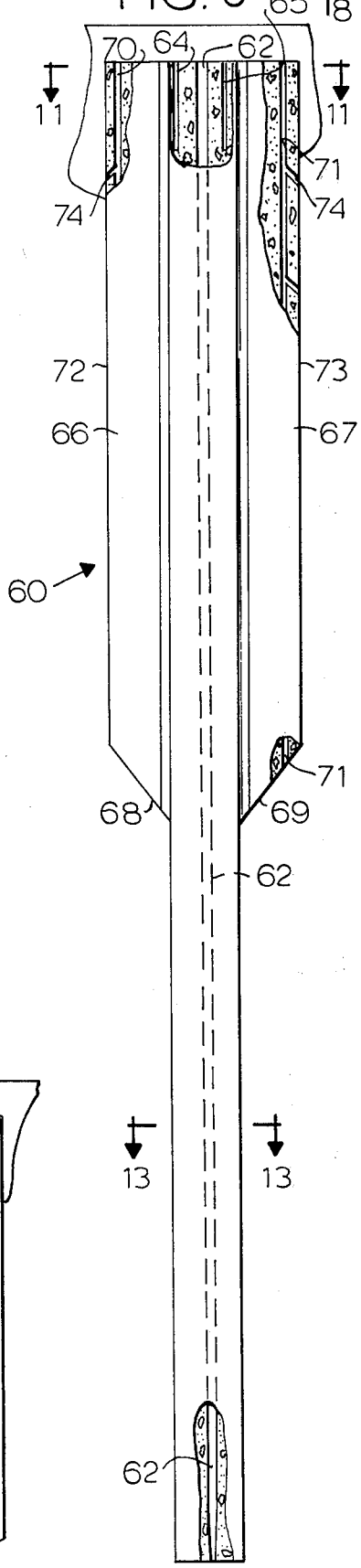
FIG. 9
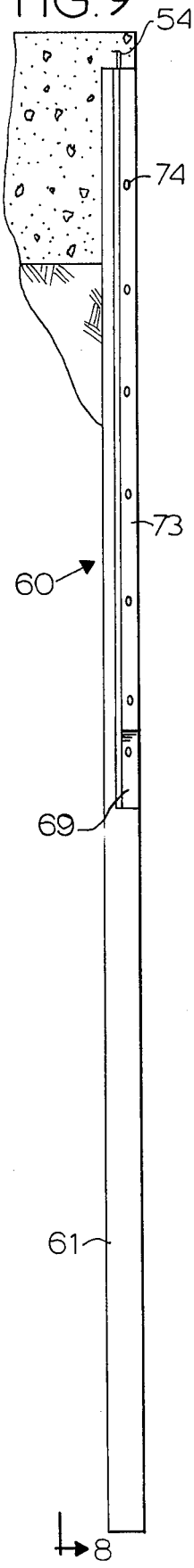
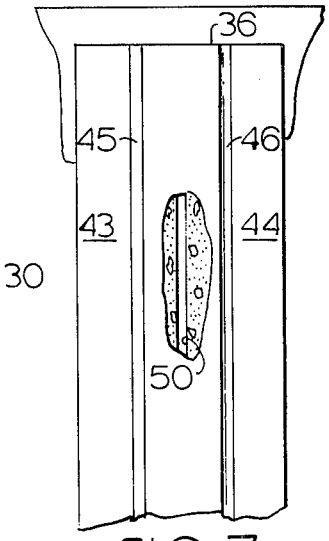
FIG. 7

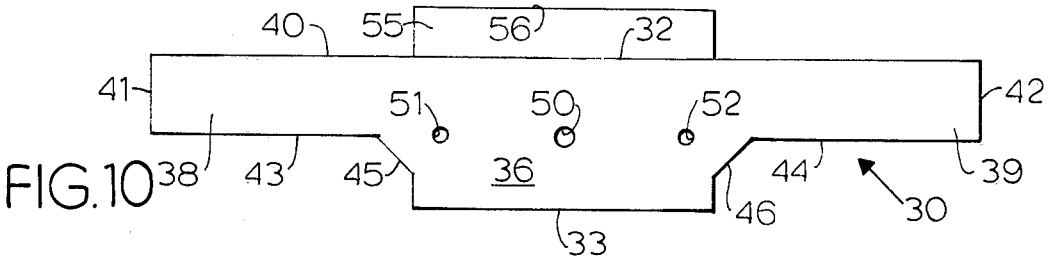
FIG. 10
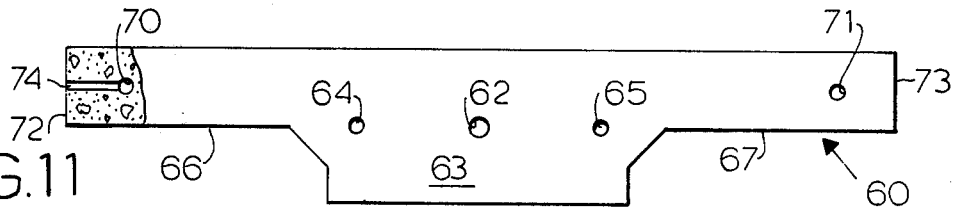
FIG. 11
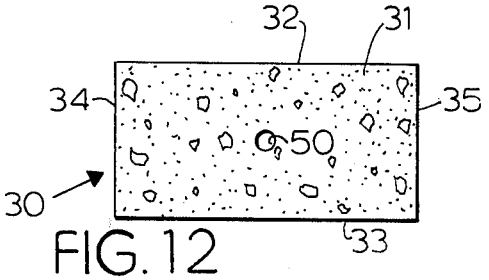
FIG. 12
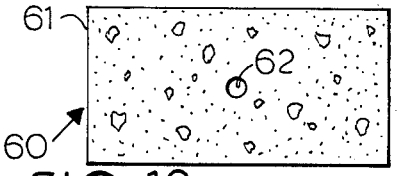
FIG. 13
FIG. 14
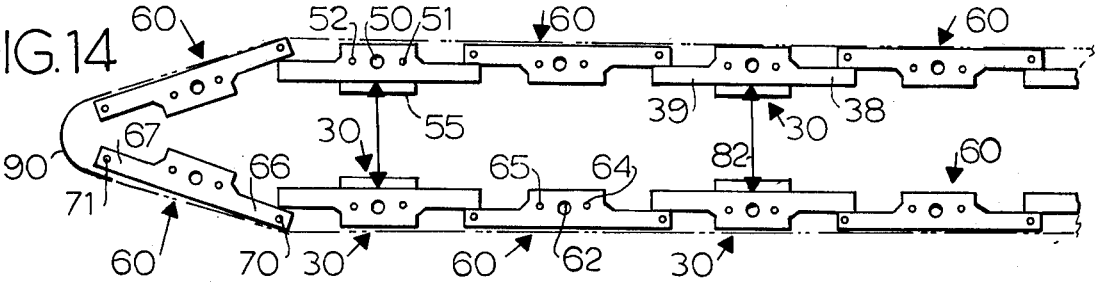
FIG. 15
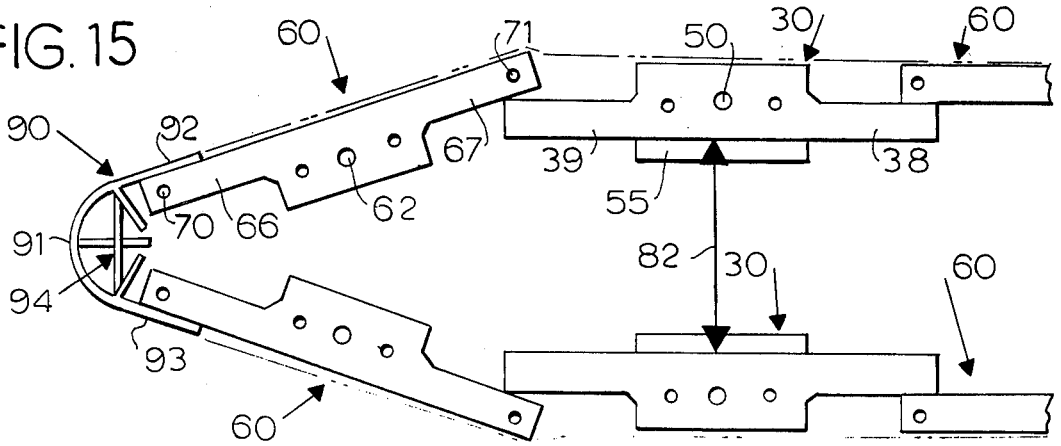

FIG. 16
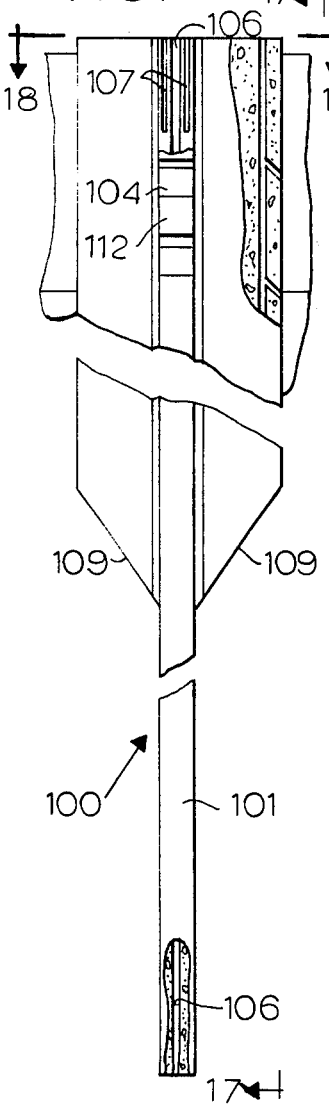
FIG. 17
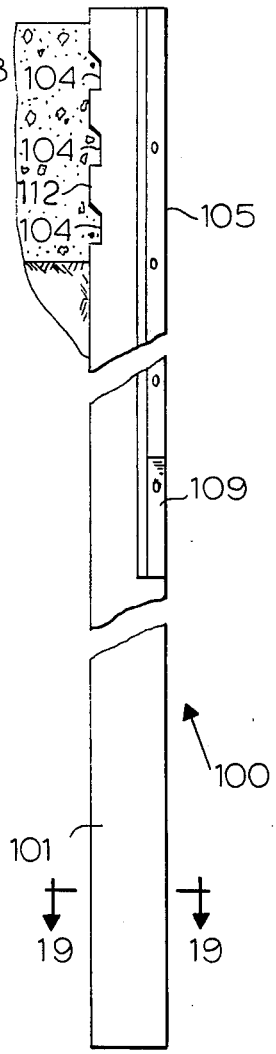
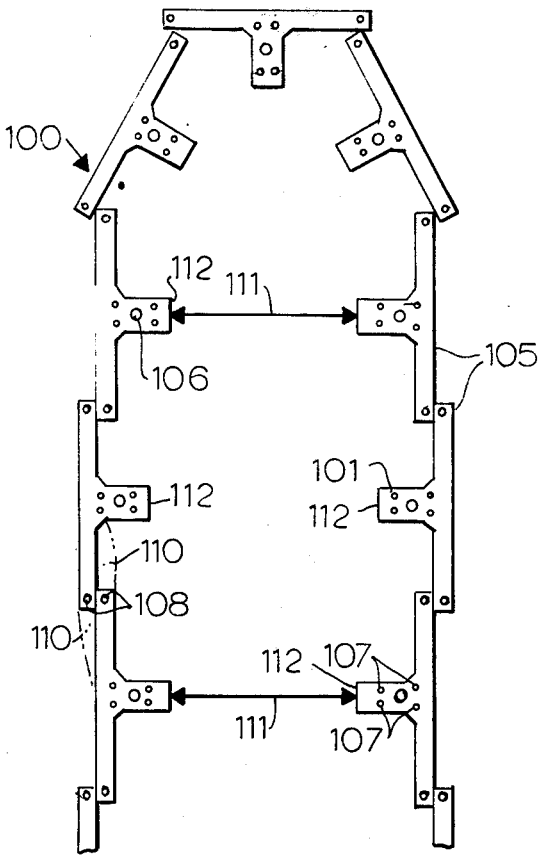
FIG. 20
FIG. 18
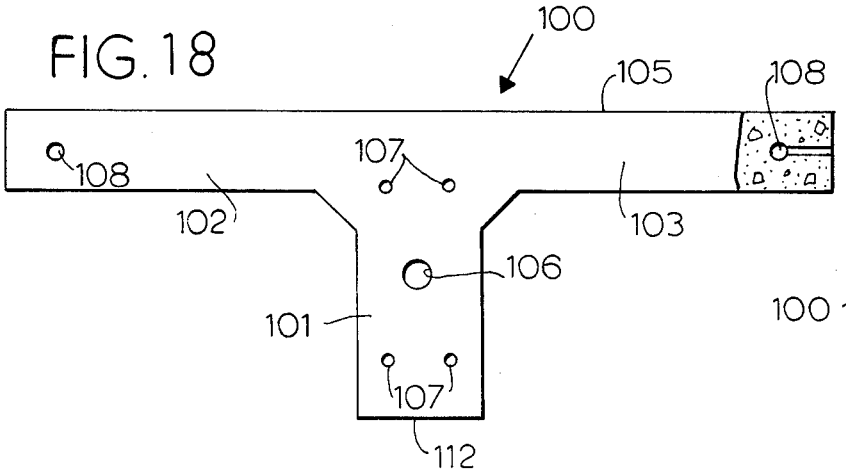
FIG. 19
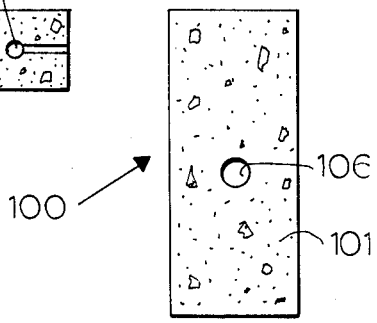

PRECAST CONCRETE PILE, AND COFFERDAMS

BACKGROUND OF THE INVENTION

This invention relates to an improved precast concrete pile. It also relates to cofferdams and the like made from such piles and to a method for constructing cofferdams, retaining walls, and the like.

Heretofore, piling has generally consisted of metal or concrete members which are substantially uniform throughout, often round for concrete and sometimes in a sheet-like shape for metal members. Sheet piling often has the disadvantage of not being strong enough in some directions of being quite strong in others, and round and rectangular piling have the disadvantage of covering only a small amount of area.

Among the objects of the present invention are the provisions of a precast concrete pile which has a shape that gives the desired strength at the desired place while also providing for the retention of water or earth pressure at the upper portion of the pile.

Another important object of the invention is to provide a type of precast concrete pile which can be readily installed.

Another object is to provide a type of concrete piling which can be used in the construction of cofferdams, retaining walls, bridge piers, and the like, in a very economical and efficient manner.

Another object is to provide a superior method for making cofferdams, retaining walls, bridge piers, and the like, and to provide the resulting superior structures.

SUMMARY OF THE INVENTION

The invention incorporates a concrete precast pile having a main stem, preferably rectangular, extending from the top to the bottom of the pile. The lower portion of the pile consists exclusively of the main stem, but its upper portion incorporates a pair of flanges that extend out from two opposite sides of the main stem and, preferably, provide a single face that is continuous with one face of the stem. The flanges are preferably thinner than the stem, and the opposite face of the flange is set back from the corresponding face of the stem, preferably being joined to it by a splayed portion. Also, it is important for the lower edges of the flanges to be tapered or diagonal, extending downwardly and inwardly toward the stem.

The pile preferably has a central vertical jet passage that extends from the top to the bottom for enabling the use of water under pressure in driving the pile. The pile also preferably has a pair or more of vertical dowel-receiving recesses at the upper face, preferably right over the stem, for connection to caps of poured concrete and such other structure. Again, the pile is preferably provided in pairs of types, although one type can be used throughout if desired. Where a pair of types is used, then one of them has route channels or chases adjacent each edge of the flange, near the upper portion at least, and also has on one face thereof a keying projection extending out from the flat face of the pile at the upper portion.

In inserting the piles, the jets are very useful, and the piles are inserted in an alternating, overlapping sequence. In one sort of sequence, all the stems are turned the same way, and in another sort of sequence the stems alternately face inwardly and outwardly of the retaining wall structure. Where they are used for bridge piers, for example, the pile members that have the key device in the upper portion are located in the inwardly-extending area so that they can be keyed into the poured concrete that will follow. During installation, grouting may also be used to tie the members together. Flexible material acting as a kind of gasket may be used to reduce leakage and obtain superior sealing where successive piles have their flanges overlap and are in approximate contact with each other.

Other objects and advantages of the invention will appear from the detailed description which follows.

BRIEF DESCRIPTION OF THE DRAWINGS

In the drawings:

FIG. 5 is a view in elevation and in section of one of the piles of FIGS. 1 and 2, with a portion of the cap as shown in FIG. 4 shown thereon. Portions have been broken away to show interior portions.

FIG. 6 is a fragmentary view in side elevation of a portion of the pile of FIG. 5 taken along the line 6—6 in FIG. 5 and showing a portion of the adjacent concrete in section.

FIG. 7 is a fragmentary view of the upper portion of the pile of FIGS. 5 and 6 as viewed along the line 7–7 in FIG. 6.

FIG. 8 is a view similar to FIG. 5, taken along the line 8—8 in FIG. 9 and showing a pile of the structure of FIG. 3 with some portions broken away to show interior portions and also with the cap shown broken partially away.

FIG. 9 is a view mostly in side elevation of the pile of FIG. 8 and showing the pile cap, etc., in section while showing the pile itself in side elevation.

FIG. 10 is a top plan view of the pile of FIGS. 1 and 2.

FIG. 11 is a top plan view of the pile of FIG. 3 with a portion thereof broken away to show interior portions.

FIG. 12 is a view in section taken along the line 12—12 in FIG. 5.

FIG. 13 is a view in horizontal section taken along the line 13—13 in FIG. 8.

FIG. 14 is a somewhat diagrammatical view of a portion of a bridge pier showing the general method of structure and the tying together of the piles in alternating fashion.

FIG. 15 is an enlargement of an end portion of FIG. 14 showing the structure in some specifics more clearly.

FIG. 16 is a view similar to FIG. 5 of another modified form of the invention, with the central portion and some of the stem broken away.

FIG. 17 is a view in side elevation of the pile of FIG. 16 and of the adjacent part, shown in section taken along the line 17—17 in FIG. 16.

FIG. 18 is a top plan view of FIG. 16.

FIG. 19 is a view in section taken along the line 19—19 in FIG. 17.

FIG. 20 is a view of a portion of a bridge pier cofferdam, or the like, employing a series of identical piles, all made like those of FIGS. 16 and 19.

DETAILED DESCRIPTION OF SOME PREFERRED EMBODIMENTS

Figure 4:
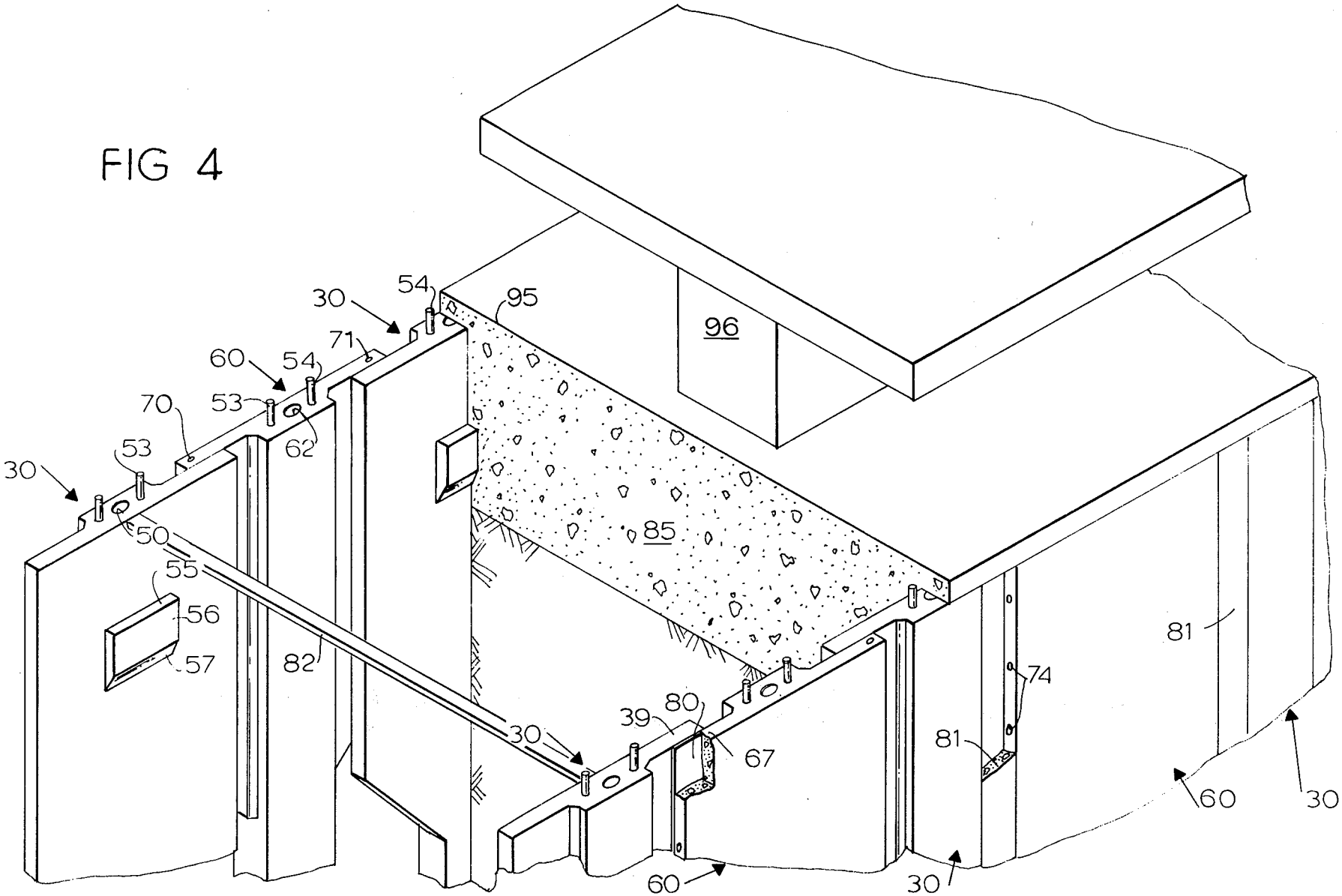
FIG. 4 is a fragmentary isometric view of a portion of a bridge pier construction embodying the principles of the invention, using the precast piles of FIGS. 1 to 3. The view has various parts broken away to show features of the piles, of the concrete pile cap, and of the trimming and other features of construction used in connection with the piles.

THE PILE AND STRUCTURE MADE THEREFROM AS SHOWN IN FIGS. 1 THROUGH 15:

In the structure shown in FIG. 4, as well as in FIGS. 14 and 15, a bridge pier, cofferdam, retaining wall, or the like, is made by employing two very similar but somewhat different types of precast concrete piles 30 and 60 embodying the principles of the invention. Each pike 30 or 60 is prestressed or reinforced or both, using well-known structure for the purpose.

Figure 1:
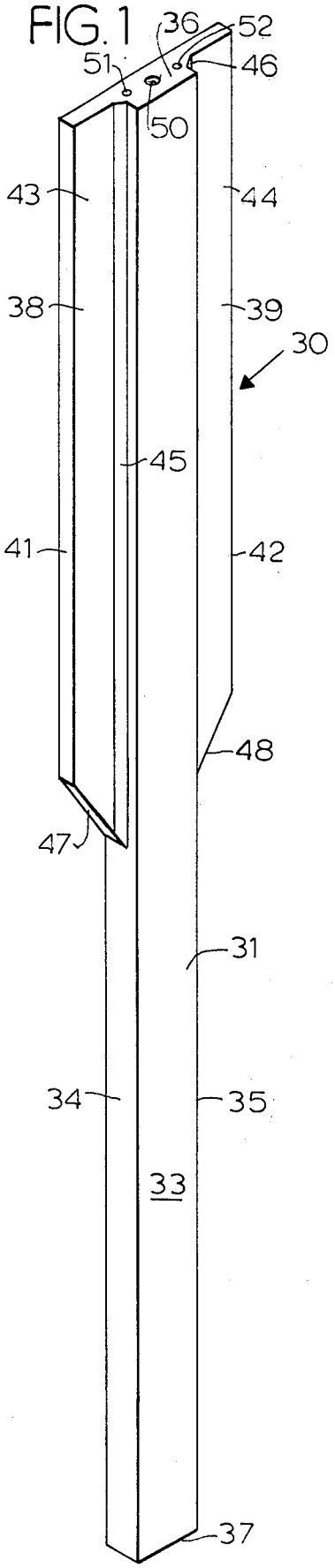
FIG. 1 is an isometric view of a precast concrete pile embodying the principles of the invention.
Figure 2:
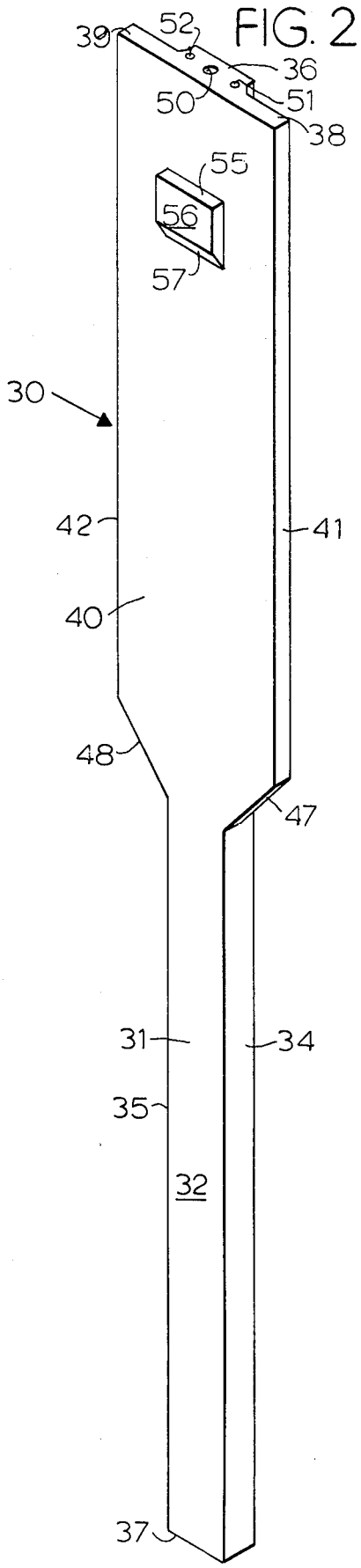
FIG. 2 is an isometric view of the same pile as FIG. 1 looking from the opposite direction.
Figure 3:
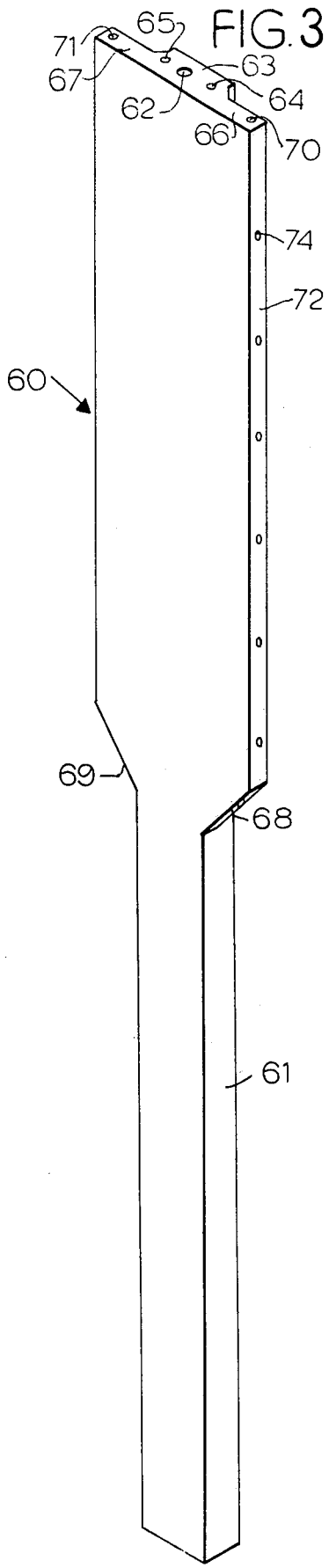
FIG. 3 is a view similar to FIG. 2 of a modified form of the concrete pile of FIGS. 1 and 2, also embodying the principles of the invention. The two types of piles shown in FIGS. 2 and 3 are preferably used together in alternating fashion, as shown in FIG. 4.

The pile 30 is shown in FIGS. 1 and 2, and also in FIGS. 5 through 7, 10, and 12. The pile 30 comprises a main stem 31 which is rectangular, having two pairs of parallel faces, namely, faces 32 and 33 which are parallel to each other and faces 34 and 35 which are parallel to each other. The stem 31 extends from the top to the bottom of the pile 30 having a top surface 36 and a bottom surface 37.

The pile 30, like all the piles of this invention, has a lower portion consisting of the stem 31, while the upper portion has, in addition to the stem 31, a pair of flanges 38 and 39. The flanges 38 and 39 have one face 40 which is preferably continuous with the face 32 of the stem 31, so that all are preferably on the same plane. The flange 38 extends out from the face 34 to an end edge 41, and the flange 39 extends out from the face 35 to an end edge 42. Face 43 and 44, respectively of the two flanges 38 and 39, are preferably parallel to the face 40 and are set back from the face 33 of the stem 31. Splays 45 and 46 join the faces 43 and 44, respectively, to the faces 34 and 35 of the stem 31. These splayed transitions are helpful in the driving of the piles 30 and in reducing the number of possibly troublesome areas. The lower edges of the flanges 38 and 39 comprises two diagonally inwardly and downwardly extending portions 47 and 48, which extend into the faces 34 and 35.

The pile 30 has a through passage 50, which extends all the way from the top face 36 to the bottom face 37 and is used for sending a jet of water therethrough to aid in installing the pile 30, particularly in areas of mud, etc.

The upper face 36 is also provided with a pair of downwardly-extending, vertical holes or recesses 51 and 52 which serve to receive dowels 53 and 54 (See FIG. 4) for tying a poured concrete cap to the precast concrete piles 30. For a similar purpose the rear face 40 of the upper portion is provided with a projection 55, which may be preferably generally rectangular with an outer surface 56 parallel to the face 40 and a sloping lower edge 57.

The second type of pile in the two-pile embodiment is a pile 60. This pile has a main stem 61 which is substantially identical to the pile 31 except that it has no member corresponding to the projection 55. It is provided with a through opening 62 for the water jet, and it has a top surface 63 with dowel openings 64 and 65. Flanges 66 and 67 are provided, and these correspond basically to the flanges 38 and 39 and have the same kind of sloping lower surfaces 68 and 69 as the faces 47 and 48, and the same splaying is used. In addition, however, there are chases 70 and 71, which are used for grouting. As shown in FIGS. 8 and 9, the chases 70 and 71 are vertical passages going all the way through the respective flanges 66 and 67, near their edges 72 and 73, with a series of outlets 74 at various intervals, preferably sloping downwardly and outwardly to the edge surfaces 72 and 73.

As shown in FIG. 4 and also in FIGS. 14 and 15, the piles 30 alternate with the piles 60 and are so driven that the piles 30 have the projections 55 face inwardly when used with such a structure as a bridge pier, where concrete is to be poured inside. The piles 60 face in the opposite direction. The resulting cofferdam type of structure operates as a form for the bridge pier itself. Installation may be by driving or by lowering the pile while a jet of water passing through the passages 50 or 62 drives the soil out of the water, or a combination of driving and jetting may be used, as is usual.

The flanges 38 and 39 of each pile 30 overlap with flanges 66 and 67 of piles 60, but need not overlap much, somewhat as shown in FIGS. 4, 14, and 15. The overlap can vary. Flexible material 80 is preferably inserted at the overlap inbetween the flanges of the two adjacent piles 30 and 60 (as shown in FIG. 4 between two flanges 39 and 67) and serves to obtain a better seal. Later, when the inside of the cofferdam has been excavated and pumped out, the water pressure outside the cofferdam tends to push the pile inward. Bracing members 82 (FIGS. 4, 14, and 15) brace opposite piles 30 against each other so that they cannot move toward each other; consequently the piles 60, which are not so braced, tend to be forced inwardly and to compress the flexible material 80 between the flanges 39 and 67, making it more watertight.

When the piles 30 and 60 are all in place, grout 81 can be used to tie them in better, by injection into the chases 70 and 71, to complete the cofferdam or cofferdam-like structure.

When a concrete pier 85 is to be poured, the concrete is poured within in the area surrounded by and defined by the piles 30 and 60 and therefore ties into the projections 55, which become keying structures, and also into the projecting portions of the stem 61 of the piles 60, which also serve as keying structures.

At each end of a bridge pier, the piles 30 or 60 may be on a diagonal, as shown in FIGS. 14 and 15, and a special end plate 90, which may be of metal may enclose the edge. A suitable structure of this is shown in FIGS. 14 an d 15; there, it includes a curved portion 91 with two flanges 92 and 93 extending back and overlying the flanges 66 and 67 of the adjacent pile 60 and with reinforcing bars 94 welded to the metal end plate 90 and extending into the center at the center of the curve and also into the adjacent parts where the curve joins the flat portion, to enable sufficient strength to be developed and tie the metal member 90 to the concrete in the center, when that is poured.

A concrete cap 95 (FIG. 4) may also be poured, locking with the dowels 53 and 54. Atop the cap 95, a pier 96 may be erected.

THE STRUCTURE OF FIGS. 16 THROUGH 20:

A pile 100, which is basically similar to what has already been shown, but has some modifications, is shown in FIGS. 16 through 20. The pile 100 has a stem 101 somewhat different in shape, and flanges 102 and 103 are constructed in the same general manner but are also somewhat differently shaped, lying along a plane face 105. Also, a keying face may be developed by recesses 104 in the face 112 opposite the plane face 105 rather than by projection from a face. A jet passage 106 is provided. Dowel openings 107, and grout chases 108 are also provided; and the lower edges 109 of the flanges 102 and 103 extend in diagonally.

In this instance, FIG. 20 shows how the pile 100 is intended to be used, with the stems 101 all facing in the same direction and affording keying in that manner. Grout 110 being used to tie the pile 100 together, as shown. Stiff rods 111 extend between opposite stems 101 at intervals to hold the respective piles 100 out away from each other and to resist push inwardly by other piles 100 that lap over their outer edges.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A precast concrete pile, comprising a rectangular main stem extending from the top to the bottom of said pile and having first and second pairs of parallel faces, said pile having a lower portion consisting exclusively of said main stem and an upper portion incorporating, integrally with said stem, a pair of generally rectangular flanges each extending out from one face of said first pair and having a first face in alignment with one face of said second pair and a second face parallel thereto and set back from the other face of said second pair, said second face being joined to said stem by a splay, said flanges being thinner than said stem, and terminating in vertical end edges, the upper end of said upper portion being flat, the lower end of said upper portion being splayed into said lower portion, a vertical grout-receiving passage going all the way through each said flange from said upper end to said lower end, each said passage being located near said end edge of a said flange, and a series of outlet passages at intervals leading outwardly from said grout-receiving passage to and through said end edge.

2. The pile of claim 1 having dowel-retention means at the top of said stem.

3. The pile of claim 1 having a keying projection capable of transmitting loads to said pile extend out from the face of said stem that is continuous with a face of said flanges.

4. A precast concrete pile, comprising a main stem extending from the top to the bottom of said pile and having first and second pairs of parallel faces and a central vertical jet passage extending from top to bottom, said pile having a lower portion consisting exclusively of said main stem and an upper portion incorporating, integrally with said stem, a pair of generally rectangular flanges, each flange extending out from one face of said first pair, both flanges having a first face in alignment with a first face of said second pair and a second face parallel thereto and set back from a second face of said second pair, said flanges being thinner than said stem, each said second face being joined to one face of said first pair by connecting splay portion, each said flange being terminated in a vertical end edge and in a lower edge that extends downwardly and inwardly toward said stem, a vertical grout-receiving passage in each said flange going all the way through said flange from top to bottom, said passage being located near to but spaced away from said end edge, and a series of downwardly and outwardly inclined outlets leading from each said passage to a said end edge.

5. The pile of claim 4 having a pair of vertical dowel-receiving recesses in the upper face of said stem.

6. The pile of claim 4 having on said first face of said stem on the upper portion thereof, spaced down from the top thereof, a projecting keying portion capable of transmitting load to said pile.

* * * * *